United States Patent [19]

Cummings

[11] 4,124,918

[45] Nov. 14, 1978

[54] RAIL AND GLIDE ASSEMBLY

[75] Inventor: David G. Cummings, Ogdensburg, N.Y.

[73] Assignee: Newell Companies, Inc., Freeport, Ill.

[21] Appl. No.: 834,296

[22] Filed: Sep. 19, 1977

Related U.S. Application Data

[63] Continuation-in-part of Ser. No. 695,250, Jun. 11, 1976, abandoned.

[51] Int. Cl.[2] ..... A47H 15/00

[52] U.S. Cl. ..... 16/93 D; 16/96 D; 16/94 D

[58] Field of Search ..... 16/96 D, 94 B, 87.2, 16/95, 93 D; 24/201 A; 248/288; 211/162; 160/347, 123, 124, 126

[56] References Cited

U.S. PATENT DOCUMENTS

| | | | |
|---|---|---|---|
| 632,343 | 9/1899 | Esser | 16/96 D |
| 2,117,606 | 5/1938 | French | 16/94 D X |
| 2,354,746 | 8/1944 | Duzmal | 248/228 |
| 2,727,272 | 12/1957 | Hankin et al. | 16/94 D |
| 2,966,696 | 1/1961 | Young | 16/94 D |
| 3,119,442 | 1/1964 | Ford et al. | 16/96 D |
| 3,521,318 | 7/1970 | Johnson | 10/87.2 X |
| 3,693,210 | 9/1972 | MacFarlane et al. | 16/87.2 X |
| 3,705,439 | 12/1972 | Cooksey | 16/94 D |

FOREIGN PATENT DOCUMENTS

| | | | |
|---|---|---|---|
| 662,096 | 2/1963 | Belgium | 16/93 D |
| 1,228,767 | 11/1966 | Fed. Rep. of Germany | 16/93 D |
| 2,041,107 | 2/1972 | Fed. Rep. of Germany | 16/93 D |
| 1,509,679 | 1/1968 | France | 16/94 D |
| 414,082 | 12/1966 | Switzerland | 16/96 D |
| 445,042 | 2/1968 | Switzerland | 16/93 D |
| 481,619 | 1/1970 | Switzerland | 16/93 D |
| 737,481 | 9/1955 | United Kingdom | 16/93 D |
| 802,124 | 10/1958 | United Kingdom | 16/93 D |
| 858,236 | 1/1961 | United Kingdom | 16/93 D |
| 869,610 | 5/1961 | United Kingdom | 16/94 D |
| 1,005,430 | 9/1965 | United Kingdom | 16/93 D |

*Primary Examiner*—Ronald Feldbaum

[57] ABSTRACT

A one-piece, rail glide system which includes a rail glide which can be assembled from the end or the side of a rail or other support structure with equal ease, said glide being resistent to disassembly from the rail throughout a wide arc of applied loosening forces, and being adaptible to low cost, mass production techniques, including extrusion forming.

5 Claims, 9 Drawing Figures fig.5.
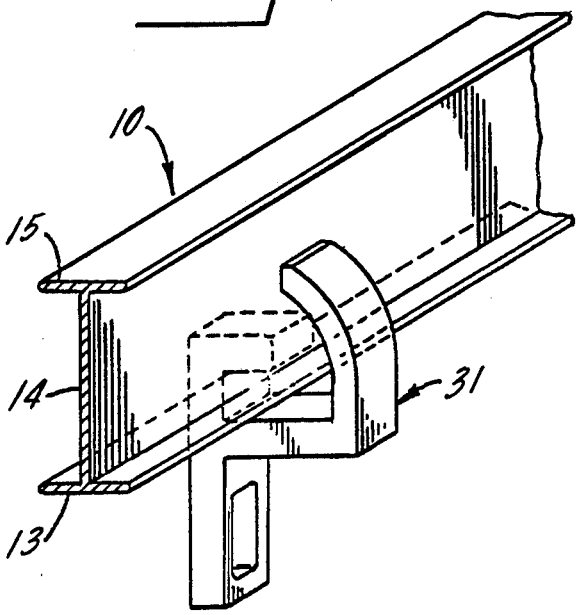
fig.6.
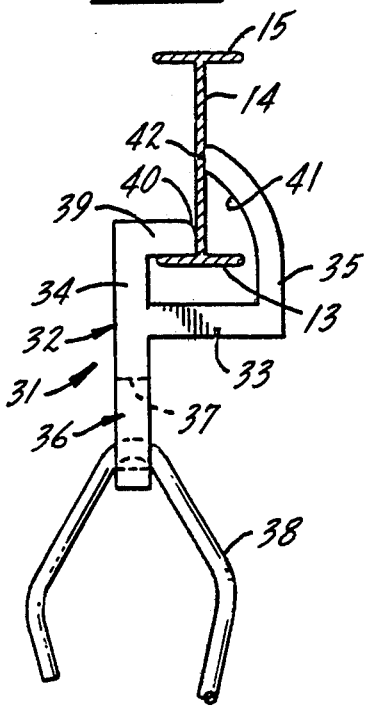
fig.7.
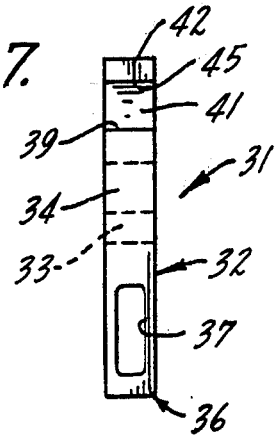
fig.8.
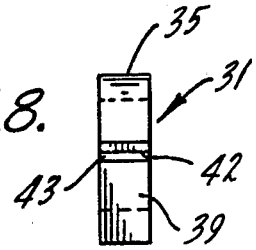
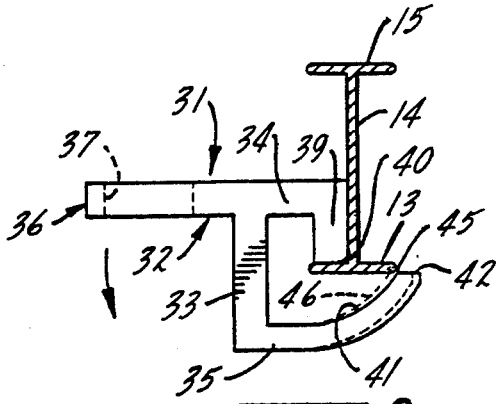
fig.9.

RAIL AND GLIDE ASSEMBLY

This is a Continuation-In-Part Application of U.S. patent application Ser. No. 695,250, filed June 11, 1976, now abandoned, of David G. Cummings, for Rail and Glide Assembly.

SUMMARY OF THE INVENTION

This invention relates generally to structures for slidably suspending objects from a flange type beam or rail supporting structure, and particularly to a rail glide member which can be assembled to a beam or rail at the ends thereof, or at any location between the ends, both before and after connection of the beam or rail to a base structure, such as a wall. The invention is particularly adapted for use in connection with hanging draperies or other relatively lightweight objects from elevated drapery rods, including the conventional I-beam curtain rod.

BACKGROUND OF THE INVENTION

Many slidable connectors for suspending curtains or other drapery from support structures, such as I-beams or rails, have been developed over the years of which U.S. Pat. Nos. 1,877,984, 2,848,735, 3,262,148, 3,346,227, 3,359,592, 3,378,879, 3,815,174, French Pat. No. 1,435,653, German Pat. Nos. 1,222,632 and 1,965,044, and British Pat. Nos. 858,236 and 869,610 are examples.

However no structure is known to the applicant which has satisfied the demand for a drapery glide which can be easily assembled or disassembled to a beam both before and after the beam is installed, and, after installation on the beam, is virtually unloosenable by application of generally downwardly applied loads thereto.

For example, some glides are only assembleable to a beam prior to installation. As a result, if it is desired to assemble additional glides to an installed beam, or to remove some or all of the glides in place on an installed beam, it is necessary to disassemble the beam from its base structure.

Other glides require specially contoured beams. Still others are relatively complicated in a mechanical sense in that they are composed of two or more parts, or are structurally intricate and thus, frequently, lack sufficient ruggedness, particularly when made from relatively inexpensive raw material. Such constructions frequently do not lend themselves to modern day mass, low cost production methods, such as extrusion forming.

Accordingly a primary object of this invention is to provide a simple, one-piece construction rail glide which can be assembled or disassembled to a beam or rail at any location thereon either prior to or after installation of the beam or rail to its base structure, such as a wall.

Another object is to provide a rail glide as above-described which is ideally adapted to fabrication by modern, low-cost mass production methods, including extrusion forming.

A further object is to provide a rail glide as above-described which, after installation, is virtually unloosenable despite application of overloads throughout a wide arc of application.

Yet a further object is to provide a rail glide as above described in which heavy, downwardly applied loads tend to increase the tightness of connection between the rail glide and the beam up to the limit of structural deformation of one component or the other.

Yet a further object is to provide a beam or rail glide assembly composed of a rail glide and a supporting member, such as a beam or rail, having all of the features above described.

Other objects and advantages will become apparent from a study of the detailed description of the invention.

DETAILED DESCRIPTION OF THE INVENTION

The invention is illustrated more or less diagrammatically in the accompanying Figures in which FIG. 1 shows a preferred embodiment of the rail glide of this invention and its mode of connection to a supporting structure, here a curtain rod;

FIG. 5 is a perspective view of another embodiment of the rail glide of this invention;

FIG. 6 is an end view of the rail glide of FIG. 5;

FIG. 7 is a side view of the rail glide of FIG. 5;

FIG. 8 is a top view of the rail glide of FIG. 5; and

FIG. 9 illustrates the mode of connection of the rail glide of FIG. 5 to an I-beam.

Like reference numerals will be used to refer to like parts from Figure to Figure throughout the description of the drawings.

Figure 1:
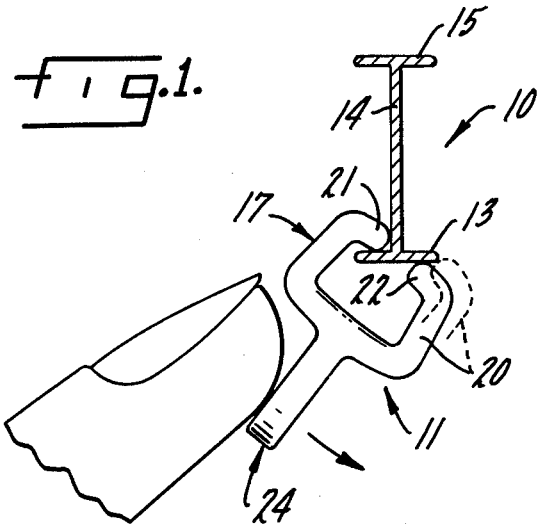

A support member, which in this instance is an I-beam secured by any suitable means (not shown) to a base structure, is indicated generally at 10 in FIG. 1. The I-beam may, for example, be a curtain rod, or it may be a shower curtain rod which is secured to a pair of opposing walls which are located substantially perpendicularly to the longitudinal axis of the beam.

The rail glide of this invention is indicated generally at 11. The rail glide is illustrated in the position it assumes during assembly to the I-beam 10 by a user.

Figure 2:
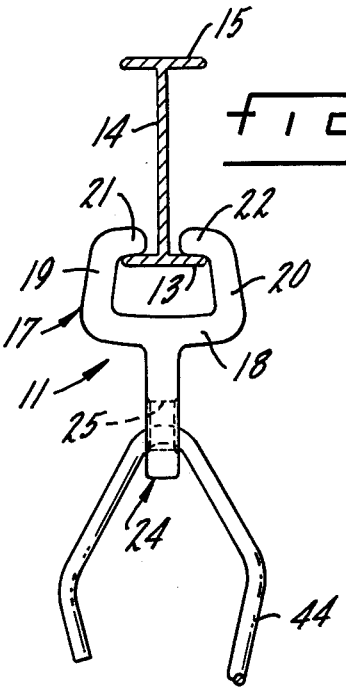
FIG. 2 is an end view of the rail glide of FIG. 1 in an assembled condition.

Referring now to FIG. 2, the support member is shown to include a lower flange member, indicated generally at 13, web means 14 which extends generally vertically upwardly from the lower flange member 13, and an upper flange member indicated generally at 15. In this instance the web 14 consists of a single plate; however, it may take other forms within the scope of the invention. It should also be understood that the upper flange member 15 may or may not be present, and that its presence is not essential to the proper function of the invention. Likewise, although the web means 14 has been illustrated as extending upwardly from lower flange member 13 along approximately the mid-line thereof, it is not essential that a cross section of the beam be symmetrical.

The rail glide 11 includes a generally U-shaped upper portion, indicated generally at 17, the U-shaped portion including a bight member indicated at 18 and a pair of arms 19 and 20 which extend generally upwardly from the bight portion 18. Each of arms 19 and 20 terminates, at its upper end, in an inwardly positioned lip or flange 21, 22, respectively.

A lower portion of the rail glide is indicated generally at 24. The lower portion 24, which is sometimes hereinafter referred to as the suspending member, extends downwardly from the approximate middle of the bight portion 18. An aperture 25 of a size suitable to receive a hook or other attachment device extends through the depending portion 24, the aperture 25 being flared at its ends to facilitate connection of an attachment member to the rail glide.

Figure 3:
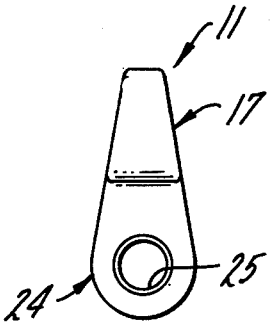
FIG. 3 is a side view of the rail glide of FIG. 1.

As can be best visualized from FIG. 3, the lower portion 24 of the rail glide is substantially wider then the upper, bight portion 18, with each portion, in this instance, melding smoothly into one another to provide a smooth-sided, converging line contour which is pleasing to the eye.

Figure 4:
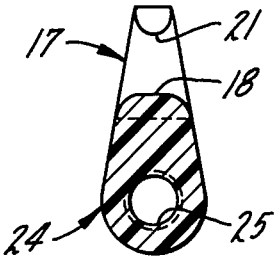
FIG. 4 is a section view through the rail glide of FIG. 1.

As best illustrated in FIG. 4, the end of each lip or flange 21, 22 is smoothly contoured on its undersurface for a purpose which will appear hereinafter.

Referring now to the embodiment illustrated in FIGS. 5 through 9, the rail glide 31 includes a generally U-shaped upper portion indicated generally at 32, the U-shaped portion including a bight member indicated at 33 and a pair of upwardly extending arms indicated at 34 and 35. A lower portion which forms a suspending member is indicated generally at 36. The suspending member extends downwardly from that side of the U-shape member containing the shorter of the two upwardly extending arms, in this instance the left side. An opening, in this instance an elongated closed slot, is indicated at 37 of a size suitable for receiving a hook 38 or other connector member.

Generally upwardly extending arm 34 terminates in a generally inwardly extending lip 39 which has an under surface adapted to make abutting engagement with the upper surface of lower flange member 13. The upper, inner corner of the lip is rounded, as at 40, for ease of assembly as will become apparent hereinafter.

The other arm 35 extends upwardly a substantial distance above the highest point attained by arm 34. Although the contour of arm 35 is not especially critical, it is preferred that the interior surface 41 have a relatively smooth, continuous configuration for ease of assembly, as will be apparent hereinafter.

As can be appreciated from FIGS. 7 and 8, the rail glide may have a uniform width from top to bottom. This configuration has the advantage, as will immediately be apparent to those skilled in the art, of enabling the glide to be formed by modern, high-speed, low-cost mass production methods such as extrusion forming.

As will be apparent from FIGS. 6 and 8, the innermost end of lip 39 and the innermost surface 42 of arm 35 are preferably so dimensioned as to provide a clearance space 43 therebetween, shown best in FIG. 8, although the provision of such a space is not absolutely essential to operation of the glide in all instances, particularly when the beam and glide are formed with smooth, continuous surfaces of materials having low co-efficients of friction.

The use and operation of the invention is as follows.

The advantages of the invention are probably best appreciated in the context of assembling a rail glide to a previously installed beam or rail. This condition requires that the rail glide be attachable to the beam at a location intermediate the support points of the beam if disassembly of the beam from its support structure is to be avoided.

To assemble rail glide 11 to rail 10, the user hooks either one of lips 21 or 22 over that portion of flange 13 which extends outwardly from web 14 closest to the user. It will be noted from FIGS. 1 and 2 that the distance between the closest points of lips 21 and 22 is substantially less then the width of lower flange 13 of rail 10.

As a consequence, the user, the assemble the rail glide 11 to the rail 10, exerts a downwardly and inwardly directed force against the lower portion 24 of the rail glide. Since assembly is from the left as viewed in FIG. 1, the downwardly and inwardly force is exerted in a counter-clockwise direction as indicated by the arrow in FIG. 1.

The upwardly and inwardly applied pressure to lower portion 24 of rail glide 11 causes the distance between lips 21, 22 to be lengthened since the material from which the rail glide is formed is resilient. As a consequence the right arm 20 of the rail glide will be displaced from its at rest condition with respect to the balance of the rail glide to an extent sufficient to enable lip 22 to clear the right edge of the right side of flange 13. This condition is illustrated by the dotted line position of arm 20 in FIG. 1, the right arm being shown at its position of maximum separation.

It will be understood that the assembly of rail glide 11 to the rail 10 will occur during one swift movement so that the user can assemble rail glides to the rail as fast as succeeding glides can be picked up and placed against the rail 10 as illustrated in the solid lines of FIG. 1.

Once assembled, the rail glide will support very heavy weights since any downwardly directed force exerted by a hook or other connector 44 will be resisted by the tensile strength of the materials forming arms 19 and 20.

To install the rail glide 31 of FIGS. 5–9, the user merely positions the rail glide substantially horizontally and in abutting engagement with the web 14 of the I-beams as illustrated in FIG. 9. As can be appreciated from that Figure, the clearance between the end of lip 39 and the end of arm 35 is such that the lower flange 13 is approximately equal to said clearance.

To assemble the rail glide to the beam, the glide, after placement in the position of FIG. 9, is swung from the generally horizontal position of FIG. 9 to the generally vertical position of FIG. 6. In this instance the movement is in a counter clockwise direction but it will be understood that the rail glide may be assembled to the I-beam from either side with equal ease.

Rail glide 31 is so contoured that the clearance between the inner end of lip 39 and the interior edge 45 of the long arm 35 is not quite as long as the width of flange 13. The disassembled, non-stressed condition which illustrates this normal configuration is indicated by the dotted line 46 in FIG. 9 and in FIG. 6.

However, as the rail glide is swung downwardly into the vertical position, the long arm 35 will be forced outwardly slightly with respect to its at-rest position illustrated in FIG. 6 with the result that only a slight effort exerted on the long lever arm, consisting of arm 34 and suspending member 36, is required to cause arm 35 to slightly deflect. Once in the vertical position of FIG. 6, arm 35 will return to its non-deflected, non-stressed condition by virtue of the yieldability of the material from which it is composed, which material may be either metal or, preferably, plastic.

During the movement of the rail glide from the position of FIG. 9 to the position of FIG. 6, the right edge of flange 13 will ride against the internal surface 41 of arm 35 in a smooth manner so that the user can detect no jerkiness or stickiness in the movement towards the vertical, installed position of FIG. 6.

The suspending member 31 is preferably secured to the bight portion 33 of the U-shaped member at a position in which it is aligned, or nearly aligned, with the bearing surface on the underside of lip 30. This results in an increase in the tightness of the connection between the glide and the beam with an increase in the load carried by the hook or other suspended member 38 and its associated load, such as a curtain. In other words, the counter-clockwise moment generated by a load acting vertically downwardly through suspending member 36 acting through lip 39 as a lever arm is resisted by a force exerted against the upper end of arm 41 where it abuts web 14. The assembly is, therefore, in effect self-locking. Loosening, short of disassembly, will only occur when the structural limitations of the material of either the rail glide or the beam are exceeded.

Although preferred and alternative embodiments of the invention have been illustrated and described, it will at once be apparent to those skilled in the art that modifications may be made within the scope of the invention. For example, the glide may be of substantially greater width as viewed in FIG. 7 with the lip 39 in effect duplicated and so arranged that one lip lies on either side of arm 35. Such a structure may provide somewhat greater stability against wobble, particularly if the width of the glide is rather small and the clearance 41 is substantially greater than the width of web 14.

Accordingly, it will be understood that the scope of the invention is not limited by the foregoing description but solely by the scope of the appended claims when interpreted in light of the pertinent prior art.

I claim:

1. A flexible rail glide, said flexible rail glide being adapted for use with a substantially rigid beam having a generally horizontally oriented flange and a generally vertically oriented web means extending upwardly from a location between the edges of the flange, said flexible rail glide beam assembleable and disassembleable to said beam from any position between the ends of the beam, said flexible rail glide being composed of a one-piece, plastic material, and including a generally U-shaped portion having a pair of arms which extend generally upwardly from a bright position which joins said generally upwardly extending arms, said pair of arms being spaced from one another near the said bight portion a distance sufficient to provide a small clearance between the inner surfaces of said upwardly extending arms and a generally horizontally oriented flange on a beam with respect to which said rail glide is adapted to be installed, each of the generally upwardly extending arms having a generally inwardly extending lip portion at the upper end portion thereof, said lip portions terminating at a position, with respect to the center of the bight portion, which is located inwardly with respect to the widest dimension of the bight portion, the distance between the innermost ends of the lip portions being so proportioned with respect to the flexibility of said rail glide as to be expandable, within the shape retention characteristic of the material from which the rail glide is formed, to a distance sufficient to enable said arms to receive, and slide past, the generally horizontally oriented flange of the beam to which the rail glide is to be assembled, and a suspending member depending from the bight portion, said suspending member having an opening therein for the reception of a hook or similar connector to be associated with the object to be slidably suspended from the glide and, in turn, a beam from which the glide is suspended.

2. The flexible rail glide of claim 1 further characterized in that the upper end of one arm terminates at a higher elevation than the upper end of the other arm when the rail glide is vertically disposed.

3. The rail glide of claim 2 further characterized in that the terminal end of the arm which terminates at the lowest elevation includes a generally flat under surface whereby the rail glide is adapted to be suspended from the upper surface of the portion of the flange member located on one side of the web means.

4. The flexible rail glide of claim 2 further characterized in that the downwardly depending suspending member is sustantially vertically aligned with the arm with which the bearing surface is associated whereby the imposition of a vertically downward pull on the suspending member will be substantially co-incident with a line perpendicular to the abutting bearing surfaces between the bottom of the shorter arm and the upper surface of the flange of the support members.

5. In combination, a beam adapted to be suspended from support means said beam having a generally vertically oriented web means extending generally vertically upwardly from a generally horizontally oriented flange means carried by the lower end portion of the web means, said flange means having a portion thereof extending generally horizontally outwardly from the web means on either side thereof, and a flexible rail glide, said flexible rail glide being assembleable and disassembleable to said beam from any position between the ends of the beam, said flexible rail glide being composed of a one-piece, plastic material, and including a generally U-shaped portion having a pair of arms which extend generally upwardly from a bight portion which joins said generally upwardly extending arms, said pair of arms being spaced from one another near the said bight portion a distance sufficient to provide a small clearance between the inner surfaces of said upwardly extending arms and a generally horizontally oriented flange on a beam with respect to which said rail glide is adapted to be installed, each of the generally upwardly extending arms having a generally inwardly extending lip portion at the upper end portion thereof.

said lip portions terminating at a position, with respect to the center of the bight portion, which is located inwardly with respect to the widest dimension of the bight portion, the distance between the innermost ends of the lip portions being so proportioned with respect to the flexiblility of said rail glide as to be expandable, within the shape retention characteristics of the material from which the rail glide is formed, to a distance sufficient to enable said arms to receive, and slide past, the generally horizontally oriented flange of the beam to which the rail glide is to be assembled, and a suspending member depending from the bight portion, said suspending member having an opening therein for the reception of a hook or similar connector to be associated with the object to be slidably suspended from the glide and, in turn, a beam from which the glide is suspended.

* * * * *